US007674963B1

(12) United States Patent
Poggi

(10) Patent No.: US 7,674,963 B1
(45) Date of Patent: Mar. 9, 2010

(54) STRING INSTRUMENT WITH VARIABLE OPENINGS

(76) Inventor: Jeffrey J. Poggi, 775 Arbor Rd., Paramus, NJ (US) 07652

( * ) Notice: Subject to any disclaimer, the term of this patent is extended or adjusted under 35 U.S.C. 154(b) by 58 days.

(21) Appl. No.: 11/746,176

(22) Filed: May 9, 2007

(51) Int. Cl.
*G10D 3/14* (2006.01)

(52) U.S. Cl. ..... 84/312 R

(58) Field of Classification Search ..... 84/312 R, 84/307, 291

See application file for complete search history.

(56) References Cited

U.S. PATENT DOCUMENTS

| | | | | |
|---|---|---|---|---|
| 1,638,423 | A | 8/1927 | Ward | |
| 1,691,168 | A | 11/1928 | Rapsevez | |
| 1,863,344 | A | 6/1932 | Lange | |
| 2,031,706 | A | 2/1936 | Hambrecht et al. | |
| 2,167,486 | A | 7/1939 | Moertel | |
| 2,270,612 | A | 1/1942 | Williams | |
| 2,523,963 | A | 9/1950 | Mitchell | |
| 3,869,954 | A | 3/1975 | Ito | |
| 4,041,830 | A | 8/1977 | Doane | |
| 4,090,427 | A | 5/1978 | Kaman | |
| D262,889 | S | 2/1982 | Pondunavac | |
| 4,317,402 | A | 3/1982 | McPherson, Sr. | |
| D270,270 | S | 8/1983 | Price | |
| 4,867,031 | A * | 9/1989 | Fender | 84/313 |
| 5,918,299 | A | 6/1999 | Yui | |
| 5,922,979 | A * | 7/1999 | Yui | 84/291 |
| 5,952,591 | A | 9/1999 | Thurman | |
| 6,060,650 | A | 5/2000 | McPherson | |
| 6,563,033 | B1 | 5/2003 | Porzilli | |
| 7,074,992 | B2 | 7/2006 | Schmidt | |
| 2004/0134329 | A1 * | 7/2004 | Turner | 84/298 |
| 2007/0012159 | A1 * | 1/2007 | Babicz | 84/307 |
| 2008/0148919 | A1 * | 6/2008 | LaMarra | 84/307 |

* cited by examiner

*Primary Examiner*—Kimberly R Lockett
(74) *Attorney, Agent, or Firm*—Richard M. Goldberg

(57) ABSTRACT

A removable insert for an opening in a wall board of a string instrument, includes a side wall having dimensions less than those of the opening for insertion in the opening, and a flange wall having dimensions greater than those of the opening so as to seat on the wall board. An arrangement is provided for releasably securing the removable insert to the wall board such that the side wall is positioned in the opening in the wall board, the arrangement including two wing brackets that are rotatably mounted to the side wall for movement between a first position within the confines of the insert in which the insert is removable from the opening and a second position in which the wing brackets are secured to an undersurface of the wall board to lock the insert in the opening.

35 Claims, 15 Drawing Sheets

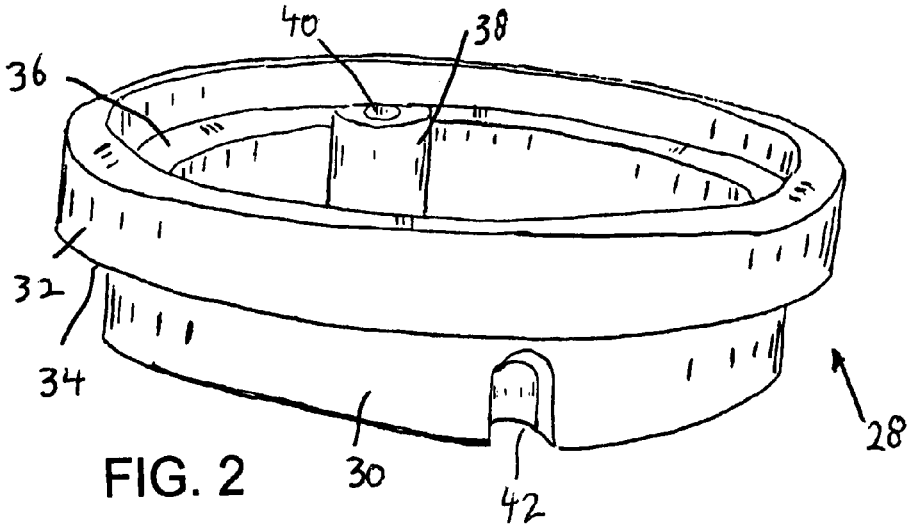
FIG. 2
FIG. 3
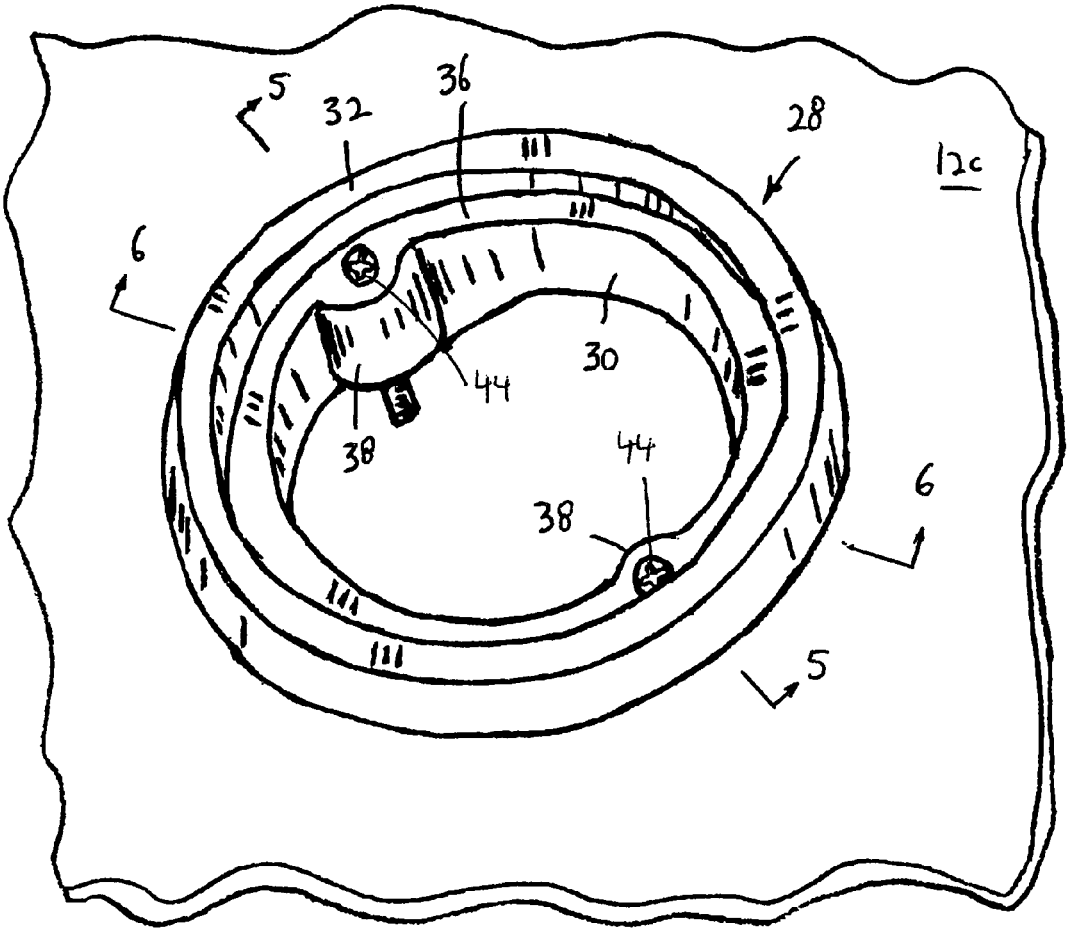

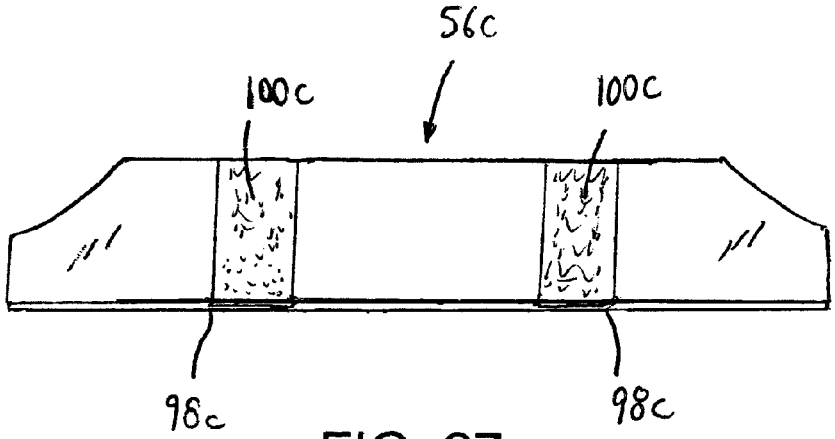
FIG. 27
FIG. 28
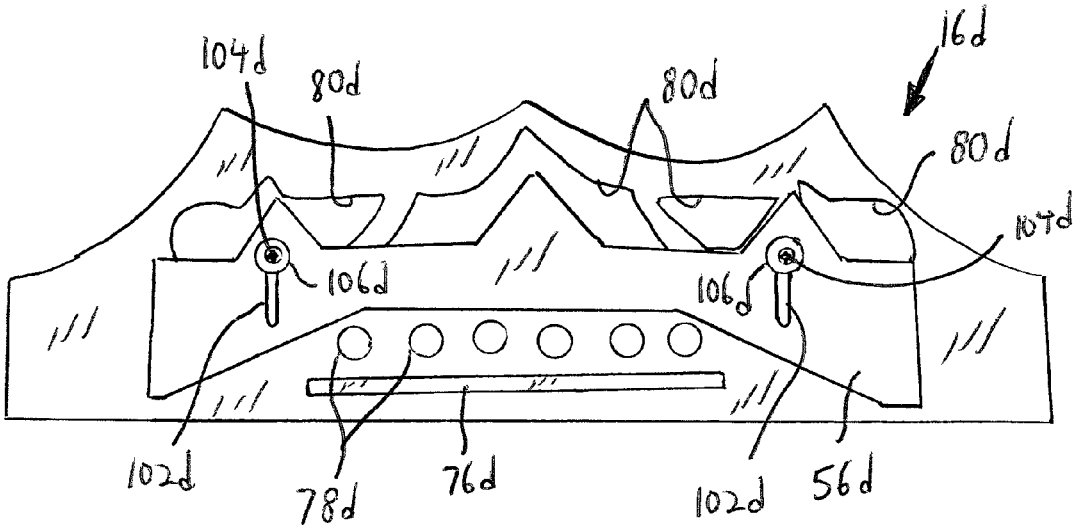

STRING INSTRUMENT WITH VARIABLE OPENINGS

BACKGROUND OF THE INVENTION

The present invention relates generally to string instruments, and more particularly, is directed to a string instrument with variable openings.

Most acoustic guitars have a single sound hole provided in the front wall of the hollow body at a location directly below the strings and at a position between the neck and the bridge of the guitar. The sound hole in combination with the hollow body of the guitar functions as a resonating chamber to amplify the sound of the guitar, without any electrical amplification. The sound hole is normally a round hole. Air inside the hollow body of the guitar vibrates as the guitar top or sound board is vibrated by the strings, and the response of the air cavity at different frequencies is characterized, like the rest of the guitar body, by a number of resonance modes at which it responds more strongly. Some sound is radiated by the movement of the air in and out of the sound hole, although the guitar top sound board is the main radiator of sound.

The sound holes in other stringed instruments generally take different shapes. For example, in the violin, f-shaped or s-shaped openings are provided on both sides of the strings.

It is also known to provide guitars with, in addition to, or as an alternative to the round sound hole, multiple smaller sound holes that produce a clearer and brighter sound. These additional sound holes have been provided at the guitar top sound board, the rear board or at the sides of the guitar.

A problem with such arrangements, however, is that the holes in the guitar are fixed in size and shape, and cannot be changed. Therefore, the sound emanating from the guitar cannot easily be changed. Further, the direction of the sound from the holes cannot be changed, and generally, the sound is emitted along an axis of each hole. Also, the holes cannot be selectively closed. Lastly, the holes are not formed as part of the bridge.

SUMMARY OF THE INVENTION

Accordingly, it is an object of the present invention to provide a string instrument that overcomes the aforementioned problems.

It is another object of the present invention to provide a string instrument having a multiplicity of holes.

It is still another object of the present invention to provide a string instrument in which the size and shape of the holes in the string guitar can be easily changed.

It is yet another object of the present invention to provide a string instrument having removable inserts in the holes.

It is a further object of the present invention to provide a string instrument having removable inserts in the holes which can be selectively closed by covers.

It is a still further object of the present invention to provide a string instrument having an adjustable scoop as part of the removable insert for directing the sound from the sound holes.

It is a yet further object of the present invention to provide a string instrument in which a hole is formed as part of the bridge in overlying relation to a sound hole in the body of the instrument in order to provide a dual function of enhancing the sound while also allowing for easy stringing.

It is another object of the present invention to provide a string instrument having a slidable cover for an opening to selectively close the opening.

In accordance with an aspect of the present invention, a removable insert for an opening in a wall board of a string instrument, includes a side wall having dimensions less than those of the opening and adapted for insertion in the opening, and a flange wall having dimensions greater than those of the opening to prevent the removable insert from falling entirely through the opening when the side wall is inserted therein, such that the flange wall is adapted to seat on the wall board. An arrangement is provided for releasably securing the removable insert to the wall board such that the side wall is positioned in the opening in the wall board, the arrangement including at least one member that is movable between a first unsecured position in which the insert is removable from the opening and a second secured position in which the insert is locked in the opening, when the side wall is fully inserted in the opening in the wall board.

Preferably, the at least one member includes at least one wing member, and the arrangement further includes at least one moving member connected with the at least one wing member for moving the at least one wing member between the first unsecured position and the second secured position. Each moving member rotatably moves the at least one wing member between the first unsecured position and the second secured position. Specifically, each moving member includes a threaded shaft rotatably mounted in the side wall, and each wing member includes a threaded opening which is threadedly engaged with the threaded shaft. In addition, each moving member also axially moves a respective wing member.

Also, the side wall includes an arrangement for preventing rotation of each wing member while permitting axial movement of each wing member. In one embodiment, this includes at least one recess in an outer surface of the side wall for receiving each wing member. In another embodiment, this includes at least one abutment in an outer surface of the side wall for preventing rotation of each wing member.

A cover is also removably securable to the insert in covering relation to the opening. The cover has an outer shape and dimensions similar to a shape and dimensions of an inner surface of the upper wall portion.

In one embodiment, the side wall includes an upper ledge at an inner surface thereof with the side wall including an upper wall portion extending above the upper ledge, and the cover is adapted to seat on the upper ledge and within the upper wall portion. In such case, the cover can frictionally fit within the upper wall portion. In a modification, a first fastener is secured to the upper ledge, and a second fastener is secured to an underside of the cover for releasable engagement with the first fastener.

In accordance with another aspect of the present invention, a scoop is removably securable in the side wall for projecting sound from the string instrument in a desired direction. The scoop includes a base for removably securing the scoop in the side wall at a desired angular position and a sound deflector shell connected with the base for projecting sound from the string instrument in a desired direction. In one embodiment, the side wall includes an upper ledge at an inner surface thereof with the side wall including an upper wall portion extending above the upper ledge, and the base of the scoop is adapted to seat on the upper ledge and within the upper wall portion. In such case, the base of the scoop has an outer shape and dimensions similar to a shape and dimensions of an inner surface of the upper wall portion. In such case, the cover frictionally fits within the upper wall portion, and/or a first fastener is secured to the upper ledge and a second fastener is secured to an underside of the base of the scoop for releasable engagement with the first fastener.

In accordance with still another aspect of the present invention, a bridge for a string instrument having at least one instrument opening, includes a generally planar member, an arrangement for holding one end of strings of the string instrument, and at least one bridge opening in the generally planar member adapted to overlie at least one instrument opening.

The arrangement for holding one end of the strings includes holes in the bridge through which the strings can extend, and/or slots in the bridge and in open communication with the at least one bridge opening through which the strings can extend. The holes and the slots are accessible through the at least one bridge opening to thread the strings therethrough.

A cover is removably securable to the bridge in covering relation to at least one bridge opening.

In one embodiment, the bridge includes a side wall defining each bridge opening, and at least one side wall includes an upper ledge at an inner surface thereof with the side wall including an upper wall portion extending above the upper ledge. The cover is adapted to seat on the upper ledge and within the upper wall portion. The cover has an outer shape and dimensions similar to a shape and dimensions of an inner surface of the upper wall portion.

In one case, the cover frictionally fits within the upper wall portion. Alternatively, a first fastener is secured to the upper ledge, and a second fastener is secured to an underside of the cover for releasable engagement with the first fastener.

In another embodiment, the bridge includes at least one cross bar support extending across at least one bridge opening for supporting the cover thereon. In such case, a first fastener is secured to the at least one cross bar support, and a second fastener is secured to an underside of the cover for releasable engagement with the first fastener.

In a still further embodiment, a cover is slidably mounted to the bridge for slidable movement between a first position in covering relation to at least one bridge opening and a second position which does not cover the at least one bridge opening. In such case, the bridge includes at least one pin extending up from an upper surface thereof, and the cover includes at least one slot for receiving the at least one pin to slidably move the cover between the first and second positions.

The above and other features of the invention will become readily apparent from the following detailed description thereof which is to be read in connection with the accompanying drawings.

BRIEF DESCRIPTION OF THE DRAWINGS

FIG. 2 is a perspective view of an insert for insertion in an additional sound hole in the guitar;

FIG. 3 is a top perspective view of the insert of FIG. 2 assembled with the guitar;

FIG. 23 is top perspective view of a further modified bridge according to the present invention;

FIG. 27 is a bottom perspective view of the cover of the bridge of FIG. 26; and FIG. 28 is a top perspective view of a yet further modified bridge according to the present invention.

DETAILED DESCRIPTION

Figure 1:
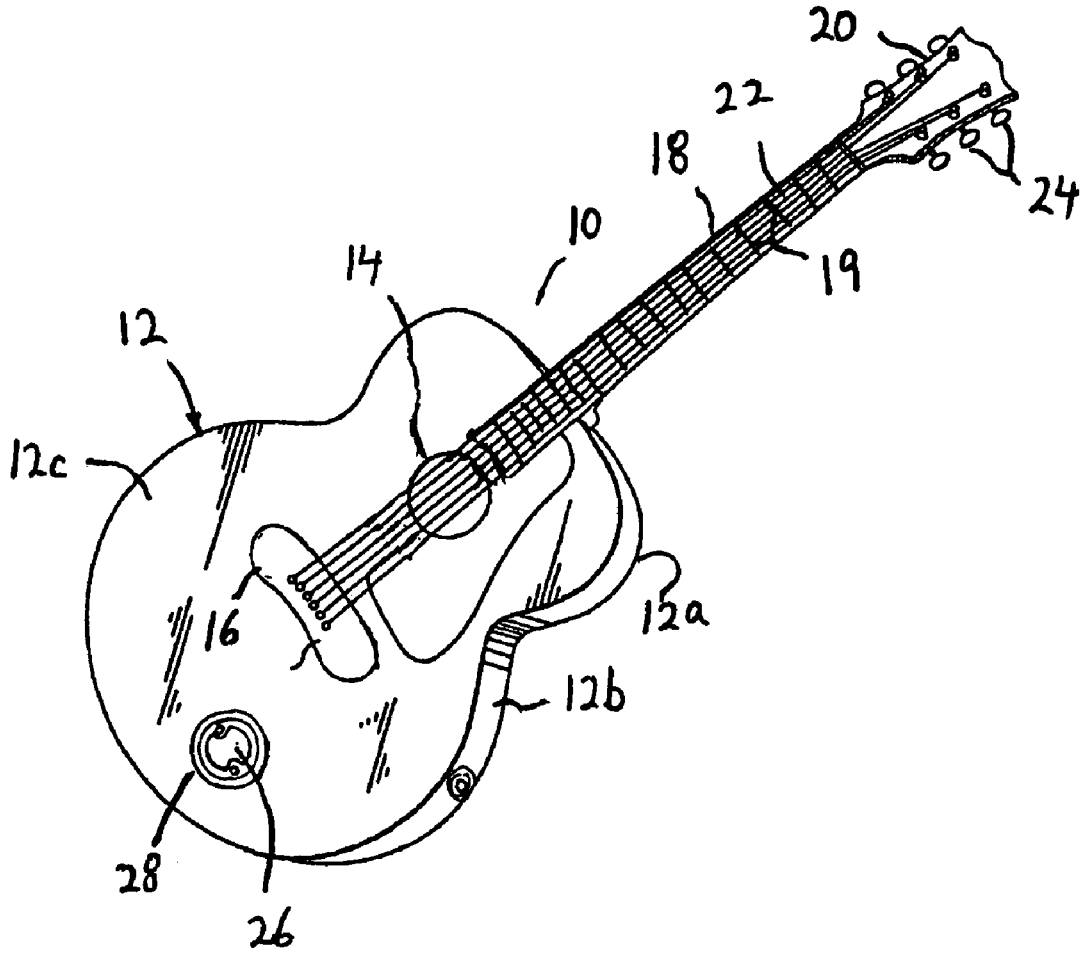
FIG. 1 is a perspective view of a guitar according to a first embodiment of the present invention.
Figure 4:
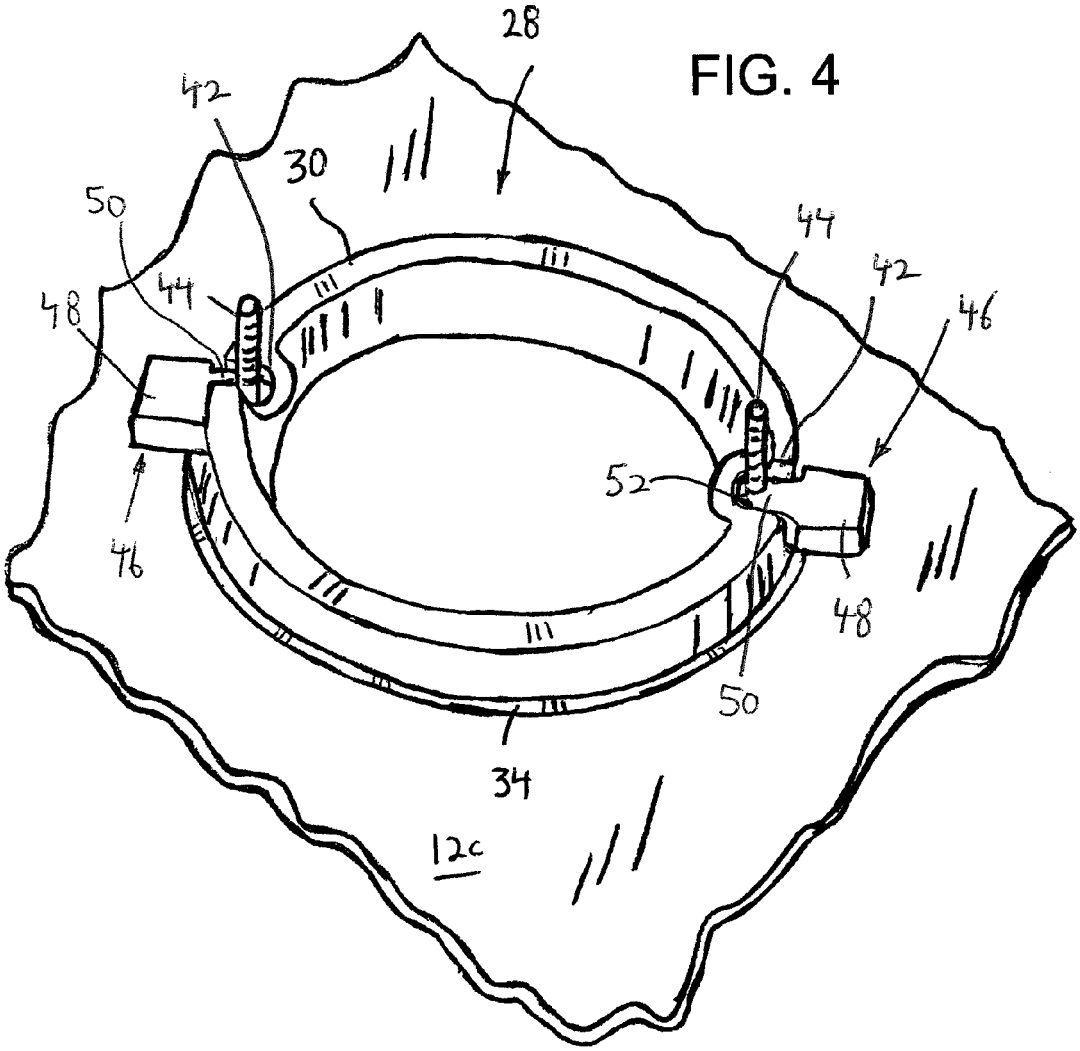
FIG. 4 is a bottom perspective view of the insert of FIG. 2 assembled with the guitar.
Figure 5:
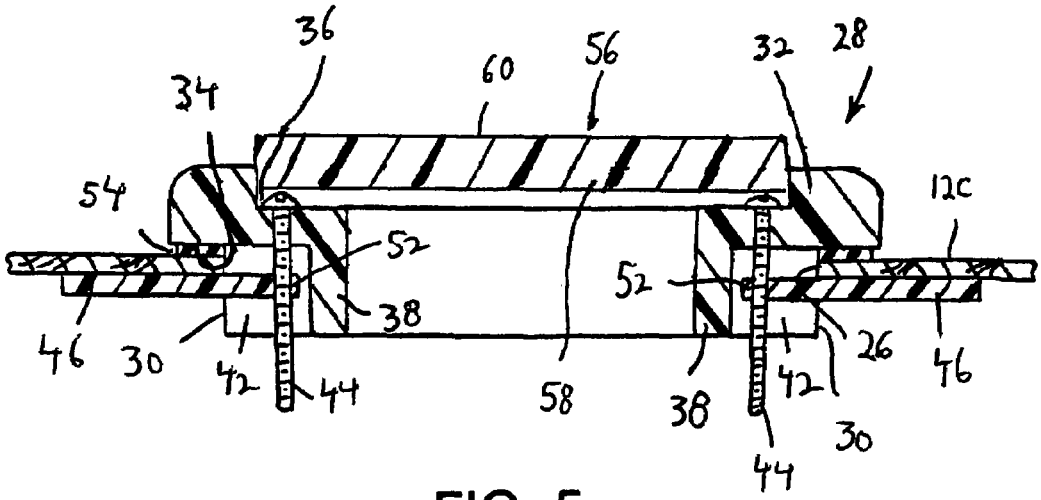
FIG. 5 is a cross-sectional view of the insert of FIG. 3, taken along line 5-5 thereof.
Figure 6:
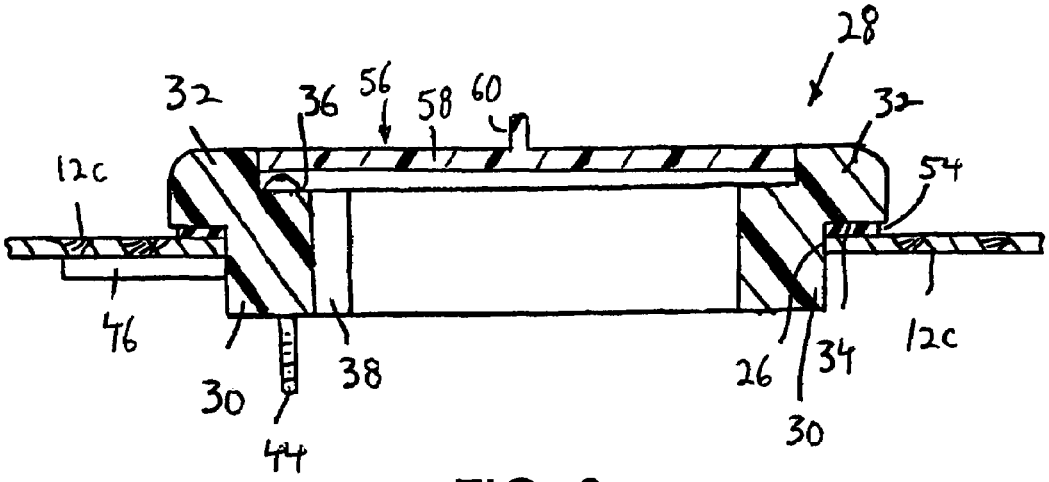
FIG. 6 is a cross-sectional view of the insert of FIG. 3, taken along line 6-6 thereof.

Referring to the drawings in detail, and initially to FIGS. 1-4 thereof, there is shown a string instrument, namely, a guitar 10, according to a first embodiment of the present invention. Guitar 10 is a conventional guitar, and it will be appreciated that the shape and size of guitar 10 can change within the scope of the present invention. Guitar 10 includes a main body 12 which has a general shape of the number "8". Main body 12 includes a rear planar board 12*a*, a side wall board 12*b* extending up from rear board 12*a* around the periphery thereof, and a top planar, sound board 12*c* connected to the opposite end of side wall board 12*b*, thereby defining a resonance chamber (not shown) therein. A round sound hole 14 is formed in sound board 12*c*, about one third of the distance from a top end thereof and formed along a lengthwise center line thereof. A bridge 16 is fixed to sound board 14 along the lengthwise center line, about one third of the distance from a bottom end thereof.

A neck 18 having frets 19 thereon, has its proximal end fixed to an upper end of main body 12, terminating just above sound hole 14. A head stock 20 is fixed to the opposite, free distal end of neck 18. Six strings 22 are secured at one end to bridge 16 and at the opposite end to tuning pegs 24 of head stock 20 in a well known manner, so as to be stretched in spaced apart, parallel relation along neck 18. However, the number of strings 22 can vary.

In accordance with a first aspect of the present invention, at least one, and preferably more than one, additional sound hole 26 is provided in rear planar board 12*a*, side wall board 12*b* and/or top planar, sound board 12*c* of guitar 10. Preferably, the additional sound holes 26 are circular, as shown in FIG. 1, but the present invention is not limited thereby, and additional sound holes 26 can take any desired shape. As shown in FIGS. 1-6, an insert 28 having the same outer shape and dimensions as a respective additional sound hole 26, is removably secured in the respective additional sound hole 26.

In a first embodiment, insert 28 has an annular shape, and specifically, includes a lower annular or side wall 30 having an outer diameter that is slightly smaller than the diameter of the additional sound hole 26 with which it is associated so as to fit therein, and an upper annular wall or flange 32 having its lower end connected at the upper end of lower annular wall 30. The outer diameter of upper annular wall 32 is greater than the diameter of the additional sound hole 26 with which it is associated such that a lower annular shoulder 34 is formed by the lower surface of upper annular wall 32 that extends radially outward from the outer surface of lower annular wall 30. Thus, when lower annular wall 30 fits within the respective additional sound hole 26, lower annular shoulder 34 seats on the outer surface of rear planar board 12*a*, side wall board 12*b* or top planar, sound board 12*c*. Preferably, the outer, upper edge of upper annular wall 32 is rounded to provide an aesthetically pleasing appearance.

In addition, the inner diameter of upper annular wall 32 is greater than the inner diameter of lower annular wall 30, such that an upper annular ledge 36 is formed by the upper surface of lower annular wall 32 that extends radially inward from the inner surface of upper annular wall 32. Two diametrically opposite part-cylindrical bosses 38 are formed along the inner surface of lower annular wall 30, each including an axially extending, through opening 40, and each extending the height of lower annular wall 32. Two diametrically cut-out areas 42 are formed through the outer wall surface of lower annular wall 30 so as to be in open communication with through openings 40.

A bolt 44 extends down through each through opening 40. A wing bracket 46 includes a generally rectangular parallelepiped section 48 and an arm 50 extending from one side of generally rectangular parallelepiped section 48. A threaded opening 52 is provided in arm 50 and threadedly receives the lower end of a respective bolt 44.

In order to removably assemble insert 28 into its respective additional sound hole 26, bolts 44 are turned until wing brackets 46 are positioned at the lower ends of bolts 44 at a position below the lower end of lower annular wall 30 and are turned inwardly so as to be within the confines of the outer diameter of lower annular wall 30. Then, lower annular wall 30 is fit within the respective additional sound hole 26 until lower annular shoulder 34 seats on the outer surface of top planar, sound board 12*c*. Preferably, an annular felt, foam or rubber gasket 54 (FIGS. 5 and 6) is positioned between top planar, sound board 12*c* and lower annular shoulder 34. Thereafter, bolts 44 are turned to rotate wing brackets 180 degrees to positions under top planar, sound board 12*c*. A person can then reach through insert 28 and hold each wing bracket 46 while turning the respective bolt 44, whereupon the wing bracket 46 is moved upwardly along the shaft of bolt 44 and within the respective cut-out area 42 until the upper surface of generally rectangular parallelepiped section 48 of the wing bracket 46 contacts the undersurface of top planar, sound board 12*c*, thereby releasably locking insert 28 in the additional sound hole 26.

To remove insert 28, bolts 44 are turned such that wing brackets 46 are moved downwardly along the shafts thereof. During the initial turning movement, the side walls defining cut-out areas 42 restrain rotational movement of wing brackets 46. Once wing brackets 46 clear the lower edge of lower annular wall 30, wing brackets 46 are no longer restrained and will rotate with bolts 44. Thus, wing brackets 46 are, turned inwardly so as to be within the confines of the outer diameter of lower annular wall 30, whereupon insert 28 can then be removed.

It will be appreciated that, while the arrangement for releasably securing removable insert 28 to top planar, sound board 12*c* has been shown by rotatable wing brackets 46, the present invention is not limited thereto, and any other moving element which achieves this result can be used. For example, radially directed slides or the like can be used. Further, while wing brackets 46 have been shown to rotate inwardly of insert 28 for removal of insert 28, the present invention is not limited thereby. For example, lower annular wall 30 can have a recess in the outer surface thereof into which each wing bracket 46 is moved during insertion and removal of insert 28. In addition, while the opening in insert 28 has been shown to be circular, the opening therein can be partially closed to provide different sound effects.

Figure 7:
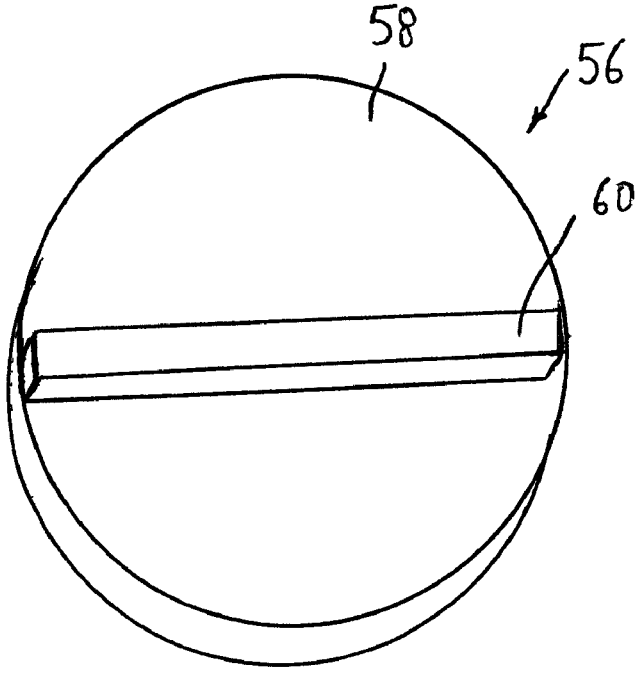
FIG. 7 is a perspective view of a cover for closing the insert.

As shown in FIG. 7, a cover 56 can be provided to close the opening of insert 28. Cover 56 includes a cylindrical puck shaped body 58 having the same shape and dimensions as the inner surface of upper annular wall 32 and, in one embodiment, is made of a resilient and slightly elastic friction material, such as rubber or the like that can slightly deform and be frictionally fit within upper annular wall 32. A grab bar 60 is preferably formed on the upper surface of cover 56 to remove and/or insert cover 56 relative to insert 28.

As a further alternative, upper annular ledge 36 can be eliminated so that there is only a smooth continuous inner wall surface, and in such case, some other arrangement such a hook/loop fastening arrangement sold under the trademark "VELCRO" can be provided on the upper surface of insert 28 and on the lower surface of cover 56 for removably holding cover 56 on insert 28.

Figure 8:
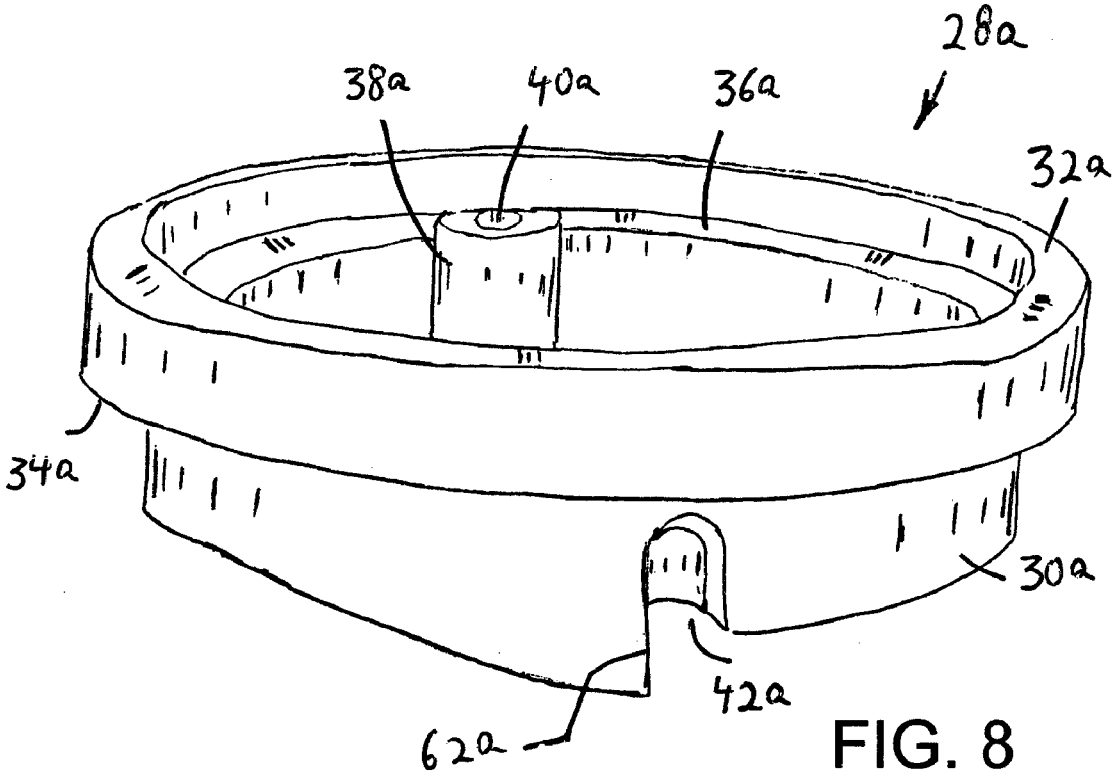
FIG. 8 is a perspective view of a modified insert, similar to the insert of FIG. 2, for insertion in an additional sound hole in the guitar.

Referring to FIG. 8, a modified insert 28*a* according to the present invention will now be described in which elements corresponding to those of insert 28 are identified by the same reference numerals, but with the letter "a" appended thereto, and a detailed description of the common elements will be omitted for the sake of brevity.

Insert 28*a* is substantially identical to insert 28, and therefore, includes lower annular wall 30*a*, upper annular wall 32*a*, lower annular shoulder 34*a*, upper annular ledge 36*a*, part-cylindrical bosses 38*a*, through openings 40*a* and cut-out areas 42*a*. However, lower annular wall 30*a* extends down to a position that is lower at one side of each cut-out area 42*a* than at the other side of each cut-out area 42*a*, so as to form a lower abutment 62*a* at one side of each cut-out area 42*a*. The reason for lower abutment 62*a* is to permit the respective wing bracket 46 to abut thereagainst during a tightening or insert securing operation in order to prevent the respective wing bracket 46 from turning with bolt 44. However, lower annular wall 30*a* at the opposite side of cut-out area 42*a* does not extend down to this lower position, so that, during a loosening or an insert removal operation, the respective wing bracket 46 can be rotated inwardly with bolt 44.

Figure 9:
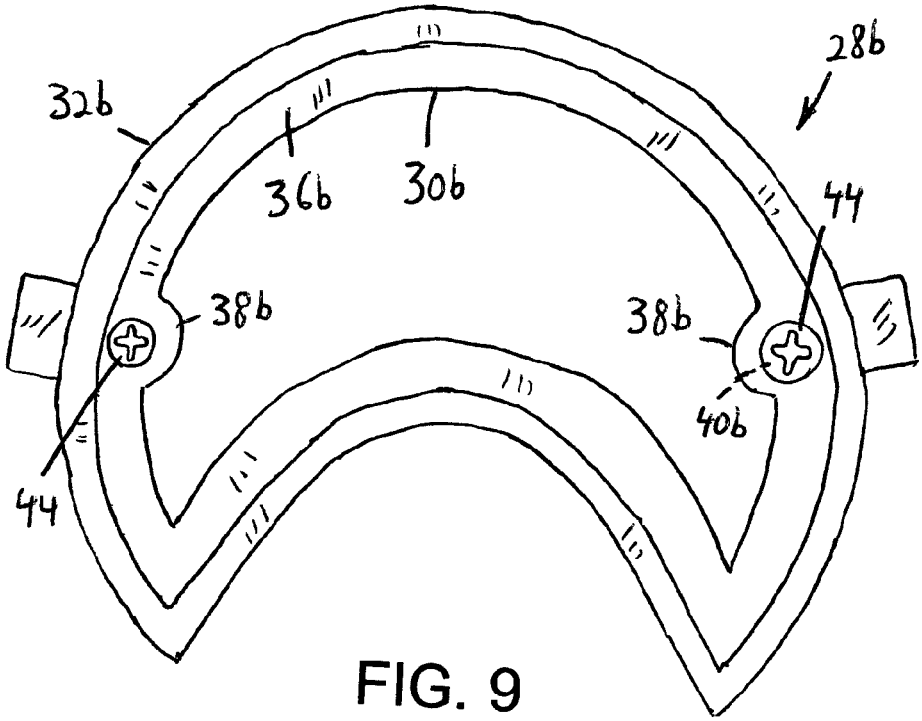
FIG. 9 is a top plan view of a further modified insert of a crescent shape for insertion in an additional sound hole in the guitar.
Figure 10:
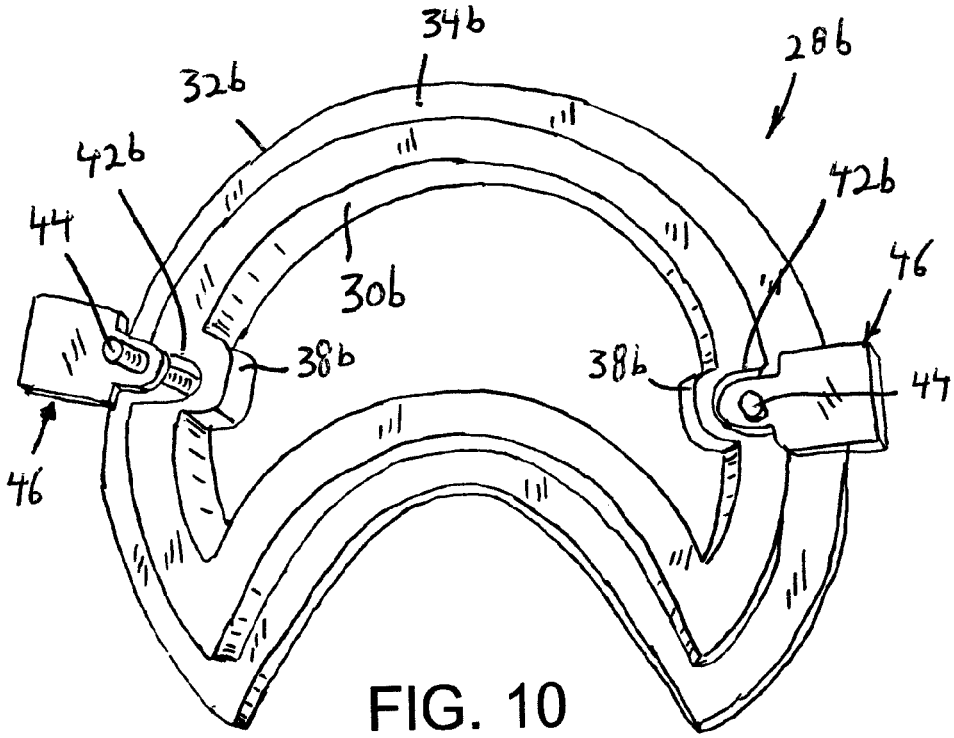
FIG. 10 is a bottom perspective view of the further modified insert of FIG. 8.

It will be appreciated that, although inserts 28 and 28*a* have been shown in an annular shape, the present invention is not limited thereby. For example, as shown in FIGS. 8 and 9, a modified insert 28*b* of a crescent shape according to the present invention is shown in which elements corresponding to those of insert 28 are identified by the same reference numerals, but with the letter "b" appended thereto, and a detailed description of the common elements will be omitted for the sake of brevity. Thus, insert 28*b* is substantially identical to insert 28, and therefore, includes lower crescent shape wall 30*b*, upper crescent shape wall 32*b*, lower crescent shape shoulder 34*b*, upper crescent shape ledge 36*b*, part-cylindrical bosses 38*b*, through openings 40*b* and cut-out areas 42*a*.

It will be appreciated that, because of the crescent shape of insert 28*b*, insert 28*b* can be used in an additional sound hole 26 of a circular shape or of the identical crescent shape.

Figure 11:
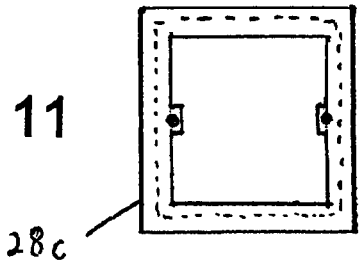
FIG. 11 is a top plan view of a further modified insert of a square shape for insertion in an additional sound hole in the guitar.
Figure 12:
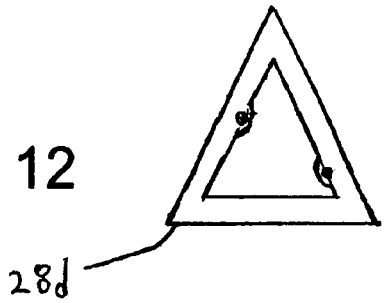
FIG. 12 is a top plan view of a further modified insert of a triangular shape for insertion in an additional sound hole in the guitar.
Figure 13:
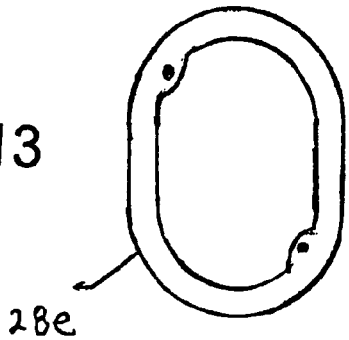
FIG. 13 is a top plan view of a further modified insert of an oval shape for insertion in an additional sound hole in the guitar.
Figure 14:
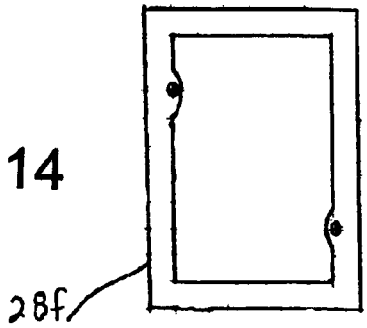
FIG. 14 is a top plan view of a further modified insert of a rectangular shape for insertion in an additional sound hole in the guitar.
Figure 15:
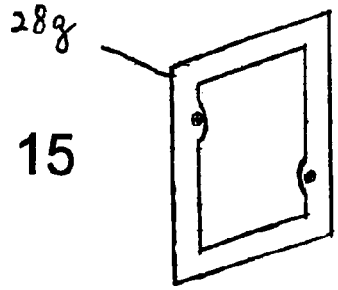
FIG. 15 is a top plan view of a further modified insert of a parallelogram shape for insertion in an additional sound hole in the guitar.
Figure 16:
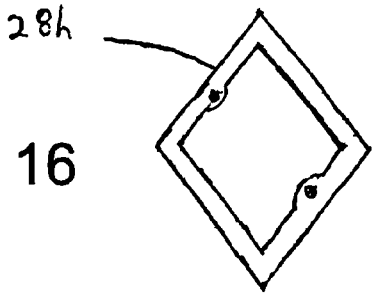
FIG. 16 is a top plan view of a further modified insert of a diamond shape for insertion in an additional sound hole in the guitar.

Any other suitable shape can also be provided, including, but not limited to, square as shown by insert 28*c* of FIG. 11, triangular as shown by insert 28*d* of FIG. 12, oval as shown by insert 28*e* of FIG. 13, rectangular as shown by insert 28*f* of FIG. 14, parallelogram as shown by insert 28*g* of FIG. 15 and diamond as shown by insert 28*h* of FIG. 15. Of course, the additional sound holes 26 would have corresponding shapes.

It will be appreciated from the above that inserts 28 and 28*a*-28*g* each have a relatively planar configuration, so that any sound emanated from guitar 10 exits the additional sound hole 26 in an axial direction, that is, perpendicular to the plane of the respective rear planar board 12*a*, side wall board 12*b* or top planar, sound board 12*c* in which the additional sound hole 26 is formed.

Figure 17:
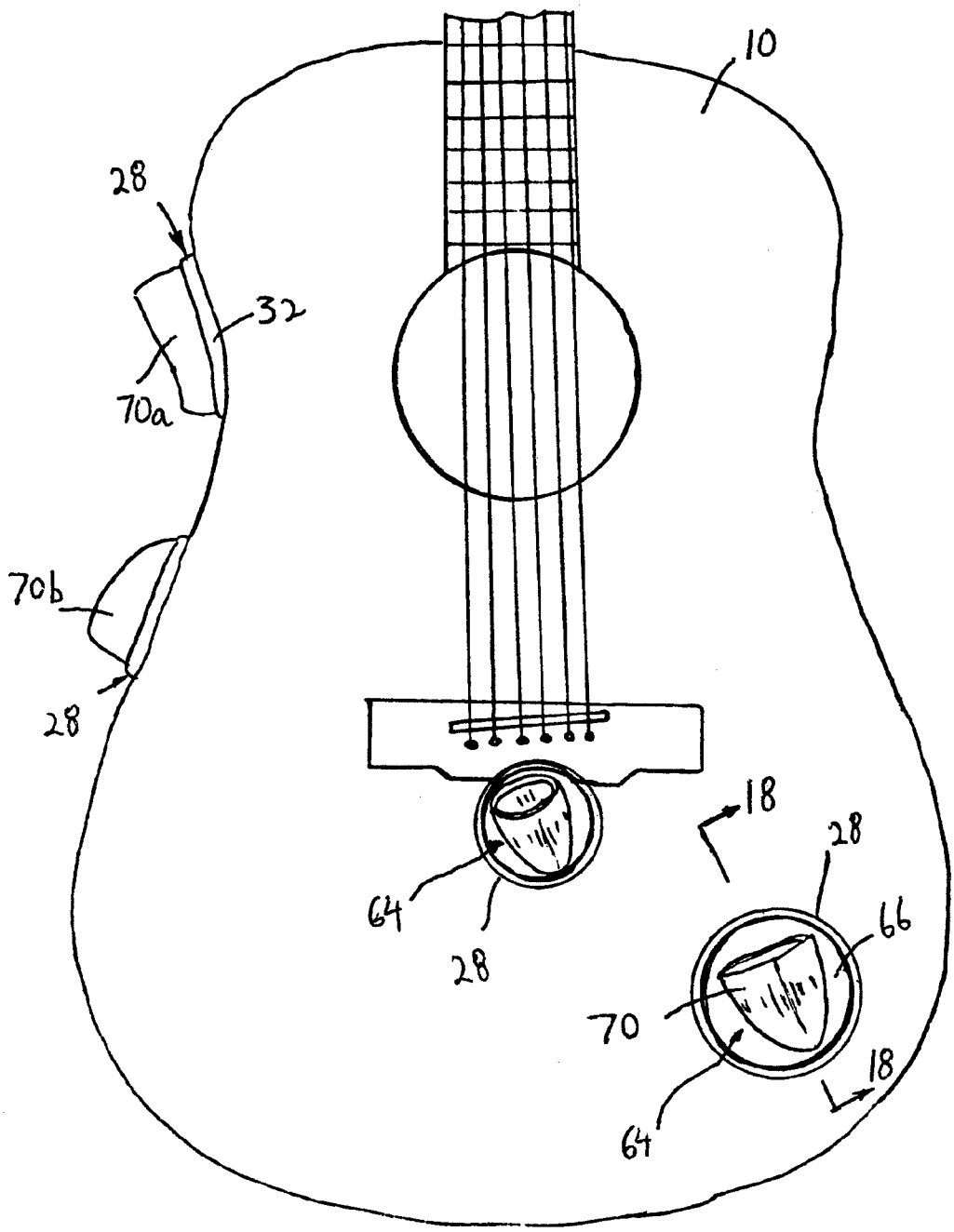
FIG. 17 is a top plan view of a guitar according to FIG. 1, with a scoop in each insert.
Figure 18:
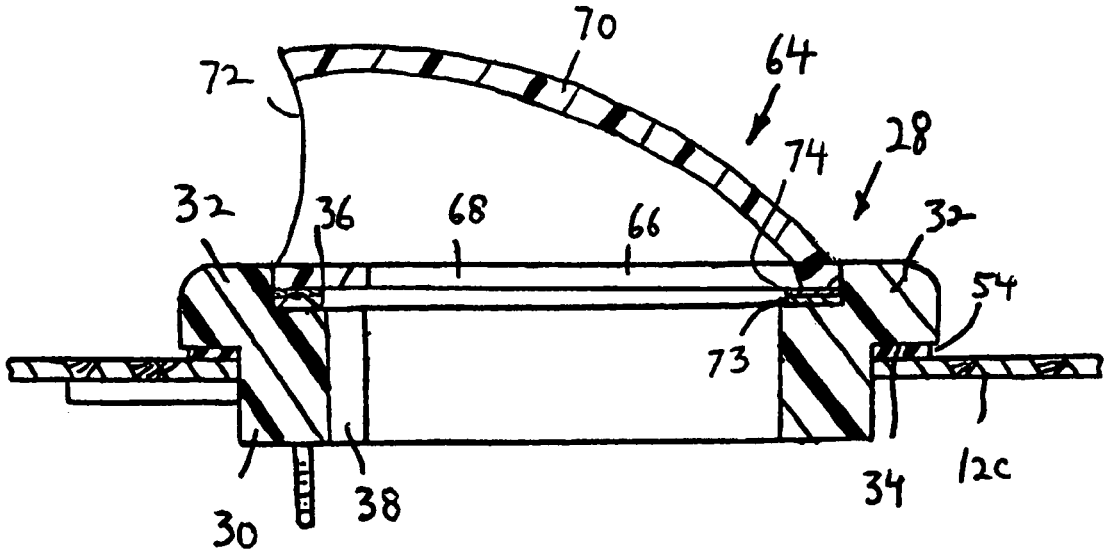
FIG. 18 is a cross-sectional view of one scoop and insert of the guitar of FIG. 17.

In accordance with another aspect of the present invention, as shown best in FIGS. 17 and 18, a shroud or scoop 64 can be inserted into the opening of each insert 28 so as to seat on upper annular ledge 36. Scoop 64 includes a base 66 of the same outer diameter as upper annular ledge 36 so as to fit therein and seat on upper annular ledge 36. An opening 68 is formed in base 66. Preferably, opening 68 has a generally parabolic shape, although the present invention is not limited thereby, and opening 68 can have any other shape, such as circular or the like. A sound deflector shell 70 of a generally parabolic shape is formed on the upper surface of base 66 in surrounding relation to opening 68 and has an open end 72 from which the sound is emanated.

In order to removably secure scoop 64 in insert 28, any suitable arrangement can be provided. For example, base 66 can be made of a resilient and slightly elastic friction material, such as rubber, foam or the like that can slightly deform and be frictionally fit within upper annular wall 32. Alternatively, or in addition thereto, a hook/loop fastener 73, such as the one commonly sold under the trademark "VELCRO", can be adhered to upper annular ledge 36, with a complementary loop/hook fastener 74, such as the one commonly sold under the trademark "VELCRO", being adhered to the undersurface of base 66 for releasably engaging hook/loop fastener 73. In either case, base 66 is releasably held in insert 28 at a desired angular position such that open end 72 can direct sound from guitar 10 in any desired direction.

Figure 19:
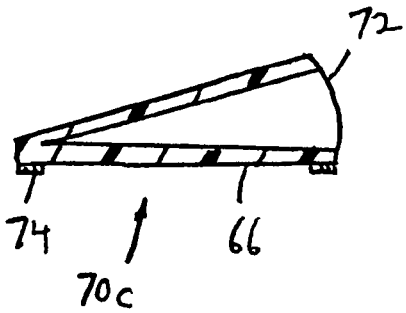
FIG. 19 is a cross-sectional view, similar to FIG. 18, showing a scoop of a different shape.
Figure 20:
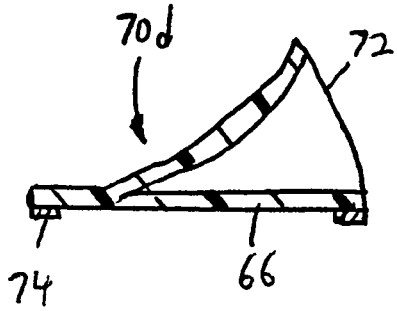
FIG. 20 is a cross-sectional view, similar to FIG. 18, showing a scoop of a still different shape.

It will be appreciated that sound deflector shell 70 can have any desired shape, and need not be of a generally parabolic shape. For example, as shown in FIGS. 17, 19 and 20, different shape sound deflector shells 70*a*, 70*b*, 70*c* and 70*d* can be provided, with openings thereof at different angles relative to the axial direction of additional sound holes 26. Preferably, sound deflector shells 70*a* and 70*b* have an annular shape, while sound deflector shells 70*c* and 70*d* have a generally shell or exponential horn shape.

Thus, with scoops 64, sound can be directed in a particular direction, for example, toward the player, toward another performer and/or toward the audience.

Figure 21:
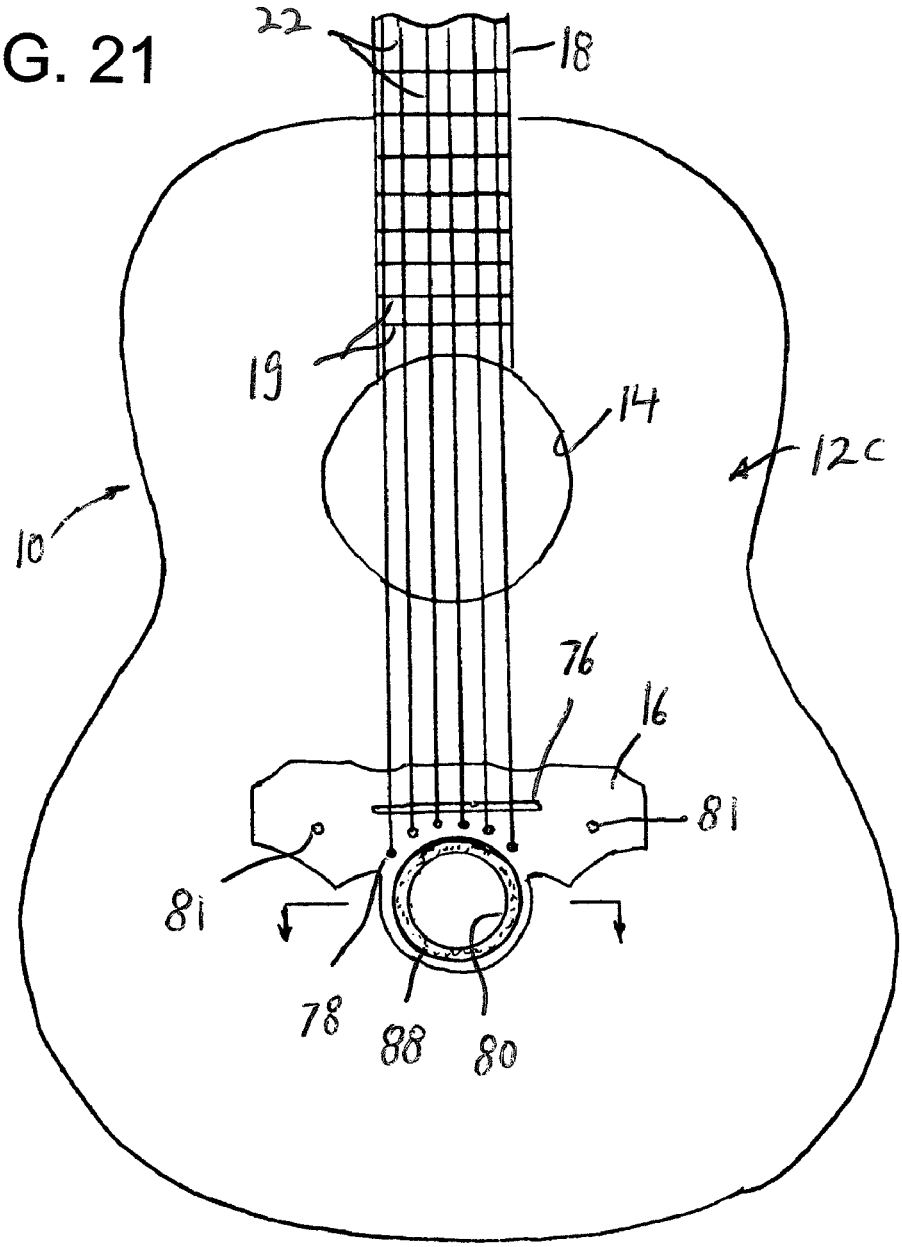
FIG. 21 is top plan view of a portion of a guitar with a bridge having a bridge hole in alignment with an additional sound hole of the guitar.
Figure 22:
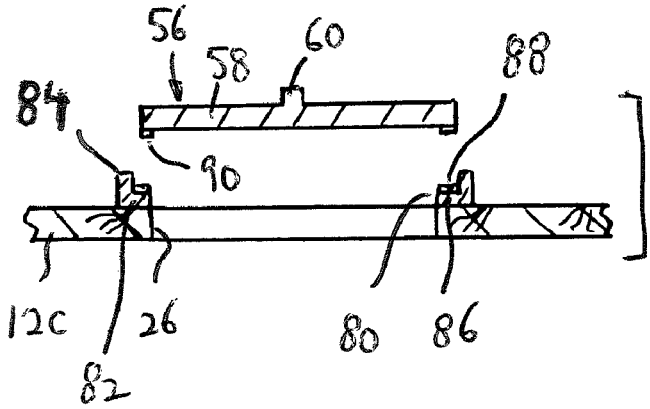
FIG. 22 is a cross-sectional view of the guitar and bridge of FIG. 21, taken along line 22-22 thereof.

As a further aspect of the present invention, as shown best in FIG. 21, the additional opening in guitar 10 can be provided as part of the bridge 16 of the guitar. Bridge 16, as with any conventional bridge, supports strings 22. Bridge 16 preferably is formed by a generally planar member formed from a single piece of material, most commonly wood, that fits between strings 22 and the resonant surface, namely, top planar, sound board 12*c*. Bridge 16 also includes a separate bearing surface on which the strings rest, termed a saddle 76, which is preferably of a material harder than bridge 16 itself, such as bone, ivory, high-density plastic, or metal. Saddle 76 may also include shallow grooves (not shown) in which strings 22 sit so as to hold strings 22 in their proper lateral position, spaced evenly from each other. Conventionally, a bridge also includes six small openings in which the strings are secured. In like manner, bridge 16 includes six small openings 78 through which strings 22 can be secured.

However, unlike conventional bridges, bridge 16 includes a bridge hole 80 which is aligned with an additional sound hole 26 therebelow, and preferably of the same size and shape, although the present invention is not limited thereby. Unlike insert 28, bridge 16 does not fit within additional sound hole 26, but is merely positioned about additional sound hole 26. This is because bridge 16 is secured to top planar, sound board 12*c* in a conventional manner through screw holes 81.

In one embodiment, bridge hole 80 is cut-away to define an L-shaped cross-section, whereby bridge hole 80 includes a lower wall section 82 that seats on top planar, sound board 12*c* and has an inner diameter equal to that of additional sound hole 26, an upper wall section 84 that has an inner diameter greater than that of lower wall section 82 and an annular ledge 86 therebetween. Preferably, a hook/loop fastener 88, such as the one commonly sold under the trademark "VELCRO", is adhered to annular ledge 86. Cover 56, previously described in relation to FIGS. 5-7, can be used to close bridge hole 80, and in this regard, cover 56 has an outer diameter which is slightly smaller than the inner diameter of upper wall section 84 and greater than the inner diameter of lower wall section 82 so as to seat on annular ledge 86. In addition, the undersurface of cover 56 at the annular periphery thereof, includes a complementary loop/hook fastener 90, such as the one commonly sold under the trademark "VELCRO", for releasably engaging hook/loop fastener 88. Further, a scoop 64 can be used therewith as well, and would include a similar a complementary loop/hook fastener, such as the one commonly sold under the trademark "VELCRO", for releasably engaging hook/loop fastener 88 in order to releasably hold scoop 64 in bridge hole 80 at a desired angular position such that open end 72 thereof can direct sound from guitar 10 in any desired direction.

In addition to bridge hole 80 serving to enhance the sound emanating from guitar 10, bridge hole 80 serves the dual purpose of also permitting easy stringing of guitar 10. As is well known in the art, guitar strings 22 generally each have a small holding cylinder (not shown) at one end thereof. With the present invention, the opposite ends of strings 22 can be inserted through small openings 78 from below top planar, sound board 12*c* through bridge hole 80 in bridge 16 and then across neck 18 to head stock 20 where they are secured by tuning pegs 24.

Figure 23:
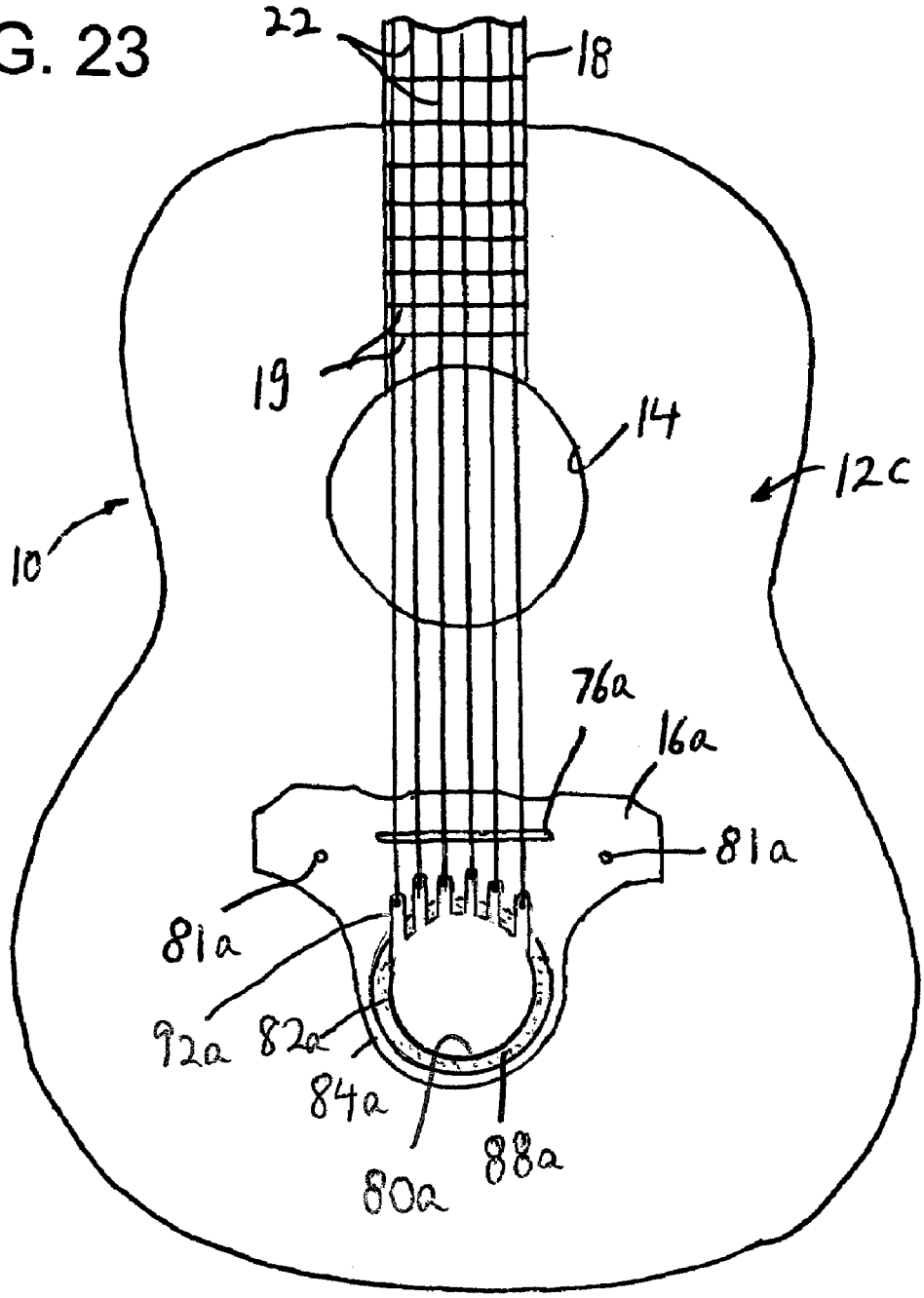
FIG. 23 is top plan view of a portion of a guitar with a modified bridge having a bridge hole in alignment with an additional sound hole of the guitar.

Referring to FIG. 23, a modified bridge 16*a* according to the present invention will now be described in which elements corresponding to those of bridge 16 are identified by the same reference numerals, but with the letter "a" appended thereto, and a detailed description of the common elements will be omitted for the sake of brevity.

Specifically, in place of small openings 78, six small slots 92*a* can be provided around the periphery of bridge hole 80*a*, with slots 92*a* extending through lower wall section 82*a* and upper wall section 84*a*. With this arrangement, the ends of strings 22 can be inserted through slots 92*a* from the inside of guitar 10, that is, through bridge hole 80*a*, such the small holding cylinder (not shown) at one end of each string 22 is held by each respective slot 92*a* at the undersurface of top planar, sound board 12*c*. Then, strings 22 are stretched across neck 18 to head stock 20 where they are secured by tuning pegs 24. As with bridge 16, bridge 16*a* also includes a saddle 76*a*, screw holes 81*a* and hook/loop fastener 88*a*.

Figure 24:
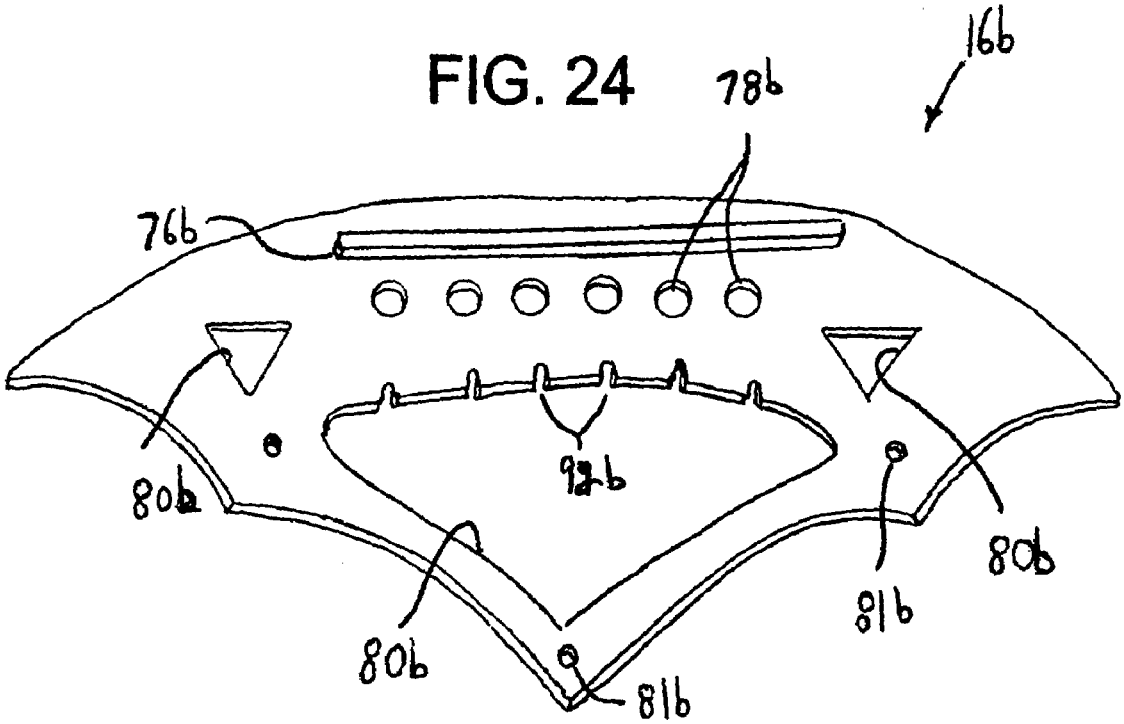
FIG. 24 is a top perspective view of a still further modified bridge according to the present invention.

Referring to FIG. 24, a modified bridge 16*b* according to the present invention will now be described in which elements corresponding to those of bridge 16 are identified by the same reference numerals, but with the letter "b" appended thereto, and a detailed description of the common elements will be omitted for the sake of brevity.

It will be appreciated that a plurality of bridge holes 80*b* can be provided in bridge 16*b* in alignment with additional sound holes 26 in top planar, sound board 12*c*. Further, it is not necessary that a cover be associated with bridge holes 80*b*, that is, bridge holes 80*b* can always remain open. As such lower wall section 82, upper wall section 84, annular ledge 86 and hook/loop fastener 88 are eliminated. This arrangement also provides that different sound quality can be engineered into the bridge to obtain a desired sound, while also providing different aesthetic appearances.

It will be appreciated that bridge 16*b* provides both six small openings 78*b* as well as slots 92*b*, and either can be used. Of course, bridge 16*b* also includes screw holes 81*b* for securing bridge 16*b* to top planar, sound board 12*c* in a conventional manner, as well as saddle 76*b*.

Figure 25:
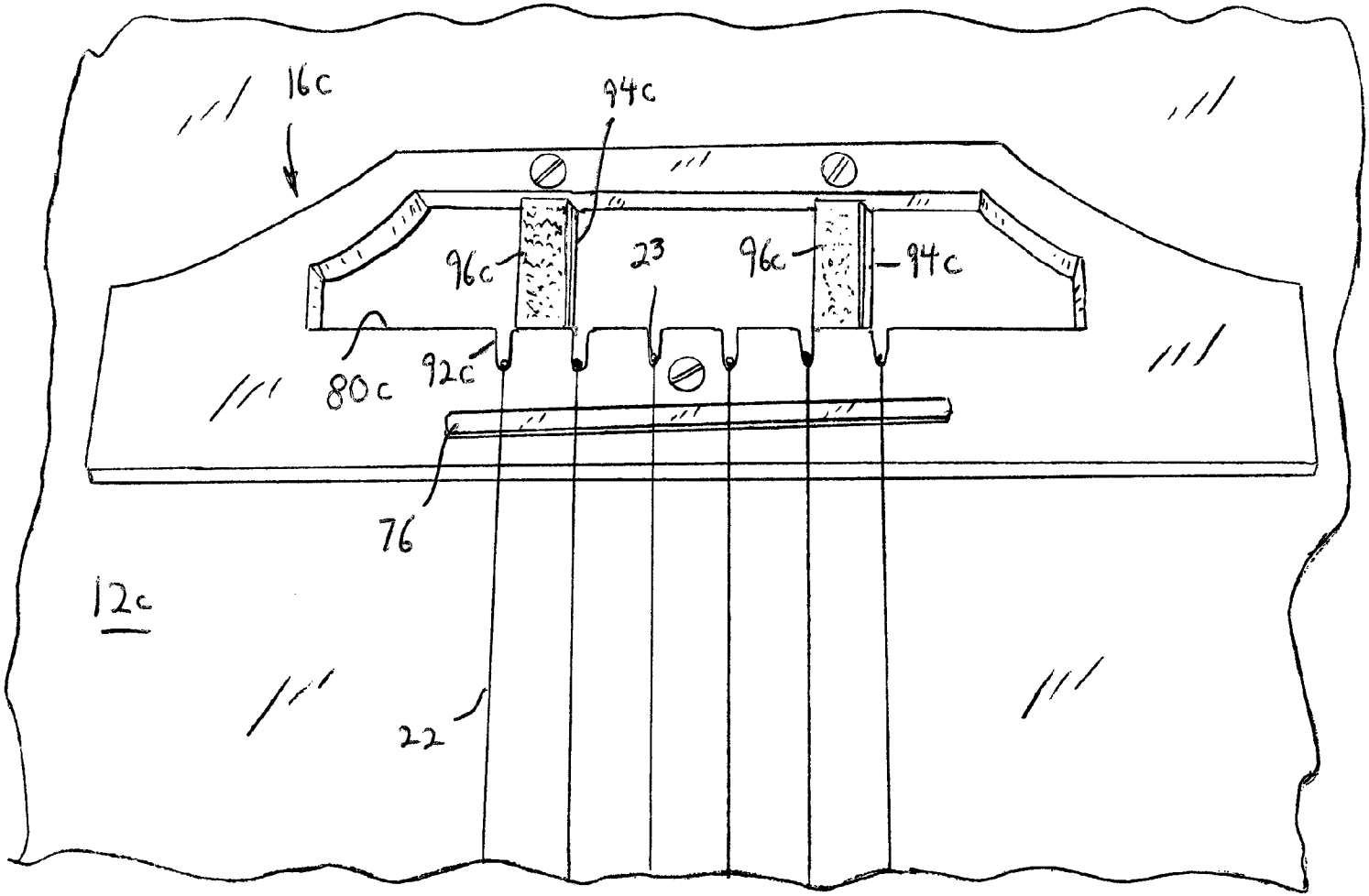
FIG. 25 is a top perspective view of a portion of a guitar with a still further modified bridge having a bridge hole in alignment with an additional sound hole of the guitar and with the cover removed.
Figure 26:
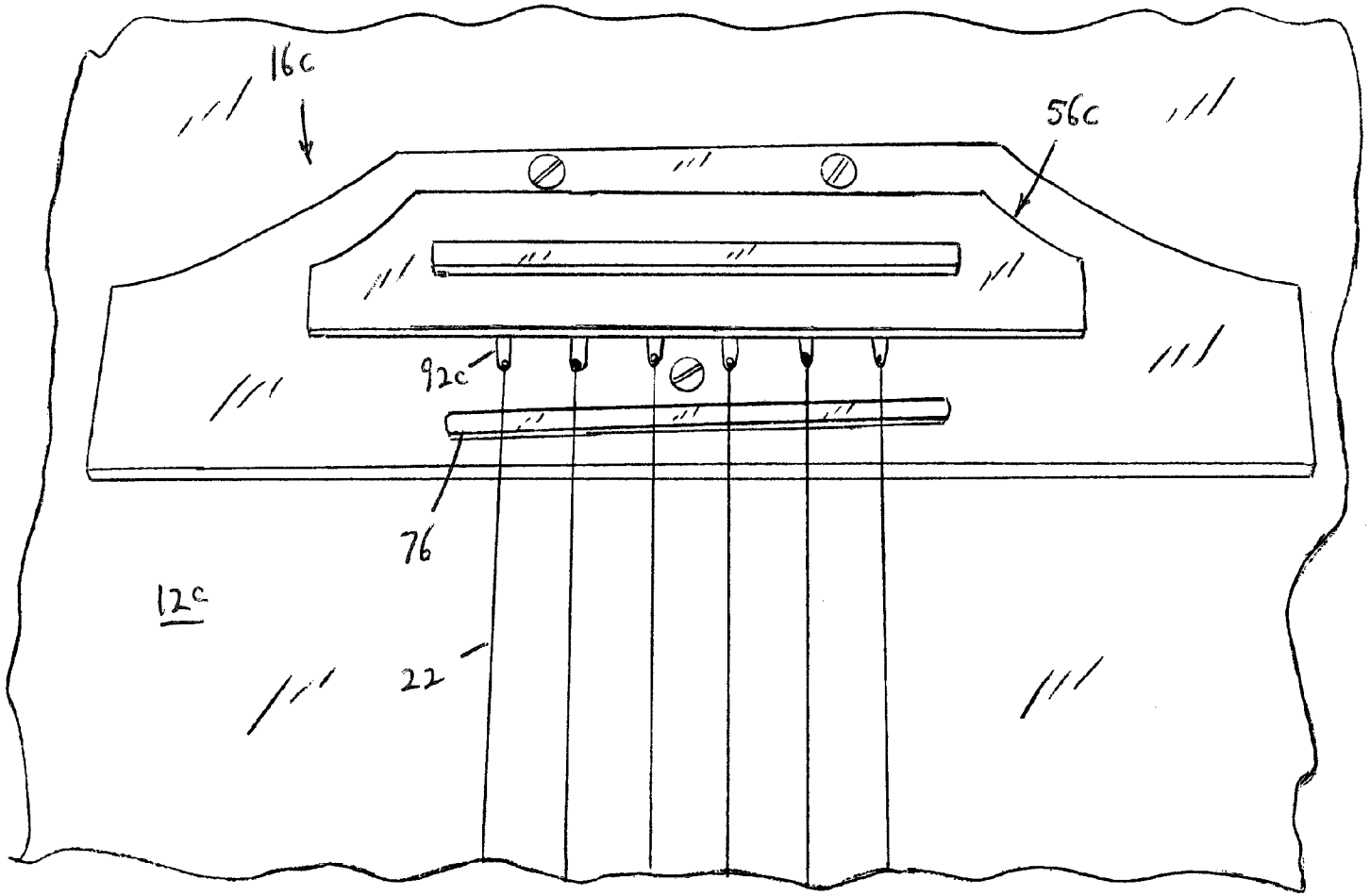
FIG. 26 is a top perspective view of a portion of a guitar with the modified bridge of FIG. 25 and with the cover thereon.

Referring to FIGS. 25-27, a modified bridge 16*c* according to the present invention will now be described in which elements corresponding to those of bridge 16 are identified by the same reference numerals, but with the letter "c" appended thereto, and a detailed description of the common elements will be omitted for the sake of brevity.

Bridge 16*c* includes an elongated bridge hole 80*c* in alignment with an additional sound hole 26 in top planar, sound board 12*c*. Six small slots 92*c* can be provided at one straight edge around bridge hole 80*c*. With this arrangement, the ends of strings 22 can be inserted through slots 92*c* from the inside of guitar 10, that is, through bridge hole 80*c*, such the small holding cylinder 23 at one end of each string 22 is held by each respective slot 92*c* at the undersurface of top planar, sound board 12*c*. Then, strings 22 are stretched across neck 18 to head stock 20 where they are secured by tuning pegs 24. Of course, as with bridge 16, bridge 16*c* also includes a saddle 76*c* and screw holes 81*c*.

Further, two cross bar supports 94*c* extend across bridge hole 80*c*, each having a hook/loop fastener 96*c*, such as the one commonly sold under the trademark "VELCRO", adhered to the upper surfaces thereof. A cover 56*c*, as shown in FIGS. 26 and 27, is provided to close bridge hole 80*c*, and includes a generally planar body 58*c* having the same shape and dimensions as bridge hole 80*c*. The undersurface of cover 56*c* includes two recesses 98*c* therein which, when cover 56*c* is in covering relation to bridge hole 80*c*, are in overlying relation to cross bar supports 94*c*. A loop/hook fastener 100*c* is secured in each recess 98*c*, releasably engaging hook/loop fastener 96*c*, to releasably hold cover 56*c* in covering relation to bridge hole 80*c*. A grab bar 60*c* is preferably formed on the upper surface of cover 56*c* to remove and/or insert cover 56*c* relative to bridge hole 80*c*.

Referring to FIG. 28, a modified bridge 16*d* according to the present invention will now be described in which elements corresponding to those of bridge 16 are identified by the same reference numerals, but with the letter "d" appended thereto, and a detailed description of the common elements will be omitted for the sake of brevity.

Bridge 16*d* includes a plurality of bridge holes 80*d* in alignment with additional sound holes 26 in top planar, sound board 12*c*, along with a saddle 76*d* and six openings 78*d* for receiving one end of strings 22 therein, with a pin (not shown) insertable in each opening 78*d* for restraining the end of the respective string 22 therein, as is conventional in the art. In order to selectively cover bridge holes 80*d*, a cover 56*d* is slidably mounted on bridge 16*d* for movement between a position in covering relation to bridge holes 80*d* and a position which does not cover bridge holes 80*d*. Specifically, cover 56*d* includes two elongated slots 102*d* extending in the lengthwise direction of guitar 10. Each slot 102*d* receives a bolt, rivet 104*d* or the like extending up from top planar, sound board 12*c* in order to slidably restrain cover 56*d* on bridge 16*d*. A washer 106*d* can be provided between the upper surface of cover 56*d* and the head of bolt 104*d* to ensure that cover 56*d* will not escape the head of bolt 104*d*.

It will be appreciated that various modification can be made to the present invention within the scope of the claims. For example, while a fastener arrangement sold under the trademark "VELCRO" has been described, any other fastener system, such as snaps, twisting locking members or the like can be used in place thereof.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. A removable insert for an opening in a wall board of a string instrument, the removable insert comprising:

a side wall having dimensions less than those of the opening and adapted for insertion in the opening;

a flange wall having dimensions greater than those of the opening to prevent said removable insert from falling entirely through the opening when the side wall is inserted therein, such that the flange wall is adapted to seat on the wall board; and an arrangement for releasably securing said removable insert to the wall board such that said side wall is positioned in the opening in the wall board, said arrangement including at least one member that is movable between a first unsecured position in which the insert is removable from the opening and a second secured position in which the insert is locked in the opening, when said side wall is fully inserted in the opening in the wall board.

2. A removable insert according to claim 1, wherein:

said at least one member includes at least one wing member; and said arrangement further includes at least one moving member connected with said at least one wing member for moving said at least one wing member between said first unsecured position and said second secured position.

3. A removable insert according to claim 2, wherein each said moving member rotatably moves said at least one wing member between said first unsecured position and said second secured position.

4. A removable insert according to claim 3, wherein each said moving member includes a threaded shaft rotatably mounted in said side wall, and each said wing member includes a threaded opening which is threadedly engaged with said threaded shaft.

5. A removable insert according to claim 3, wherein each said moving member also axially moves a respective said wing member.

6. A removable insert according to claim 5, wherein said side wall includes an arrangement for preventing rotation of each said wing member while permitting axial movement of each said wing member.

7. A removable insert according to claim 6, wherein said at least one arrangement for preventing rotation of each said wing member while permitting axial movement of each said wing member includes at least one recess in an outer surface of said side wall for receiving each said wing member.

8. A removable insert according to claim 7, wherein said least one arrangement for preventing rotation of each said wing member while permitting axial movement of each said wing member includes at least one abutment in an outer surface of said side wall for preventing rotation of each said wing member.

9. A removable insert according to claim 1, further comprising a cover removably securable to said insert in covering relation to the opening.

10. A removable insert according to claim 9, wherein said side wall includes an upper ledge at an inner surface thereof with said side wall including an upper wall portion extending above said upper ledge, and said cover is adapted to seat on said upper ledge and within said upper wall portion.

11. A removable insert according to claim 10, wherein said cover has an outer shape and dimensions similar to a shape and dimensions of an inner surface of said upper wall portion.

12. A removable insert according to claim 10, wherein said cover frictionally fits within said upper wall portion.

13. A removable insert according to claim 10, further comprising a first fastener secured to said upper ledge, and a second fastener secured to an underside of said cover for releasable engagement with said first fastener.

14. A removable insert according to claim 1, further comprising a scoop removably securable in said side wall for projecting sound from the string instrument in a desired direction.

15. A removable insert according to claim 14, wherein said scoop includes a base for removably securing said scoop in said side wall at a desired angular position and a sound deflector shell connected with said base for projecting sound from the string instrument in a desired direction.

16. A removable insert according to claim 15, wherein said side wall includes an upper ledge at an inner surface thereof with said side wall including an upper wall portion extending above said upper ledge, and said base of said scoop is adapted to seat on said upper ledge and within said upper wall portion.

17. A removable insert according to claim 16, wherein said base of said scoop has an outer shape and dimensions similar to a shape and dimensions of an inner surface of said upper wall portion.

18. A removable insert according to claim 16, wherein said base frictionally fits within said upper wall portion.

19. A removable insert according to claim 16, further comprising a first fastener secured to said upper ledge, and a second fastener secured to an underside of said base of said scoop for releasable engagement with said first fastener.

20. An adjustable scoop for projecting sound from the string instrument in a desired direction, the scoop being mounted in an opening in a wall board of a string instrument, the scoop comprising:

an insert mounted to at least one said opening;

a base for removably securing said scoop in said insert at a desired angular position; and a sound deflector shell connected with said base for projecting sound from the string instrument in a desired direction.

21. A removable insert according to claim 20, wherein insert includes aside wall having an upper ledge at an inner surface thereof, with said side wall including an upper wall portion extending above said upper ledge, and said base of said scoop is adapted to seat on said upper ledge and within said upper wall portion.

22. A string instrument comprising:

a body having a resonant cavity therein;

a neck extending from the body;

a headboard connected to a free end of the neck;

a plurality of strings stretched across the neck from the headboard to the body;

at least one opening in the body from which sound emanates from the cavity;

an insert removably mounted to at least one said opening, the removable insert comprising:

a side wall having dimensions less than those of the opening and adapted for insertion in the opening;

a flange wall having dimensions greater than those of the opening to prevent said removable insert from falling entirely through the opening when the side wall is inserted therein, such that the flange wall is adapted to seat on the wall board; and an arrangement for releasably securing said removable insert to the wall board such that said side wall is positioned in the opening in the wall board, said arrangement including at least one member that is movable between a first unsecured position in which the insert is removable from the opening and a second secured position in which the insert is locked in the opening, when said side wall is fully inserted in the opening in the wall board.

23. A bridge for a string instrument having a main body including:

a resonant cavity therein, a wall having a sound hole through which sound is emitted from the resonant cavity to an exterior of the string instrument, and at least one additional through opening, the bridge comprising:

a generally planar member secured to the main body;

an arrangement for holding one end of strings of the string instrument; and at least one bridge opening in the generally planar member adapted to overlie at least one said additional through opening in a manner to provide open communication between an interior and exterior of said string instrument such that sound is further emitted from the resonant cavity to an exterior of the string instrument therethrough.

24. A bridge according to claim 23, wherein said arrangement for holding one end of the strings includes one of:

a) holes in the bridge through which the strings can extend, and b) slots in the bridge and in open communication with the at least one bridge opening through which the strings can extend.

25. A bridge according to claim 24, wherein said holes and said slots are accessible through said at least one bridge opening to thread said strings therethrough.

26. A bridge according to claim 24, further comprising a cover removably securable to said bridge in covering relation to at least one said bridge opening.

27. A removable insert according to claim 26, wherein said bridge includes a side wall defining each said bridge opening, and at least one said side wall includes an upper ledge at an inner surface thereof with said side wall including an upper wall portion extending above said upper ledge, and said cover is adapted to seat on said upper ledge and within said upper wall portion.

28. A removable insert according to claim 27, wherein said cover has an outer shape and dimensions similar to a shape and dimensions of an inner surface of said upper wall portion.

29. A removable insert according to claim 27, wherein said cover frictionally fits within said upper wall portion.

30. A removable insert according to claim 27, further comprising a first fastener secured to said upper ledge, and a second fastener secured to an underside of said cover for releasable engagement with said first fastener.

31. A removable insert according to claim 26, wherein said bridge includes at least one cross bar support extending across at least one said bridge opening for supporting the cover thereon.

32. A removable insert according to claim 31, further comprising a first fastener secured to said at least one cross bar support, and a second fastener secured to an underside of said cover for releasable engagement with said first fastener.

33. A bridge according to claim 24, further comprising a cover slidably mounted to said bridge for slidable movement between a first position in covering relation to at least one said bridge opening and a second position which does not cover said at least one said bridge opening.

34. A bridge according to claim 31, wherein said bridge includes at least one pin extending up from an upper surface thereof, and said cover includes at least one slot for receiving said at least one pin to slidably move said cover between said first and second positions.

35. A string instrument comprising:

a main body having:

a resonant cavity therein, a wall having a sound hole through which sound is emitted from the resonant cavity to an exterior of the string instrument, and at least one additional through opening;

a neck extending from the body;

a headboard connected to a free end of the neck;

a plurality of strings stretched across the neck from the headboard to the body; and a bridge comprising:

a generally planar member secured to the main body;

an arrangement for holding one end of strings of the string instrument; and at least one bridge opening in the generally planar member adapted to overlie at least one said additional through opening in a manner to provide open communication between an interior and exterior of said string instrument such that sound is further emitted from the resonant cavity to the exterior of the string instrument therethrough.

* * * * *